US011480173B2

(12) United States Patent
Zubeidat et al.

(10) Patent No.: US 11,480,173 B2
(45) Date of Patent: Oct. 25, 2022

(54) PRESSURE RELIEF VALVE INTEGRATED IN PIVOT PIN OF PUMP

(71) Applicant: Stackpole International Engineered Products, Ltd., Mississauga (CA)

(72) Inventors: Abdalhameed Zubeidat, Rösrath (DE); Haytham Elgamal, Aachen (DE); Hans Peter Kutzer, Gangelt (DE)

(73) Assignee: STACKPOLE INTERNATIONAL ENGINEERED PRODUCTS, LTD., Mississsauga (CA)

( * ) Notice: Subject to any disclaimer, the term of this patent is extended or adjusted under 35 U.S.C. 154(b) by 355 days.

(21) Appl. No.: 16/751,499

(22) Filed: Jan. 24, 2020

(65) Prior Publication Data

US 2020/0248686 A1 Aug. 6, 2020

Related U.S. Application Data

(60) Provisional application No. 62/799,449, filed on Jan. 31, 2019.

(51) Int. Cl.

| | |
|---|---|
| ***F04C 14/24*** | (2006.01) |
| ***F04C 14/22*** | (2006.01) |
| *F04C 2/344* | (2006.01) |

(52) U.S. Cl.

CPC ..... *F04C 14/24* (2013.01); *F04C 14/226* (2013.01); *F04C 2/3442* (2013.01); *F04C 2210/14* (2013.01)

(58) Field of Classification Search

CPC .... F04C 15/064; F04C 14/223; F04C 2/3442; F04C 14/24; F04C 14/226

See application file for complete search history.

(56) References Cited

U.S. PATENT DOCUMENTS 970,348 A * 9/1910 Osborne ..... F16K 3/08 137/543.13

2,142,275 A 1/1939 Lane (Continued)

FOREIGN PATENT DOCUMENTS

CA 2664067 10/2009
JP 2012-007640 * 1/2012

(Continued)

OTHER PUBLICATIONS

English Machine translation of KR20180044699A description (Year: 2018).*

(Continued)

*Primary Examiner* — Nathan C Zollinger
(74) *Attorney, Agent, or Firm* — Pillsbury Winthrop Shaw Pittman, LLP

(57) ABSTRACT

Disclosed is a pump for dispensing lubricant to a system. The pump includes: a housing having an inlet for inputting lubricant into the housing and an outlet for delivering the lubricant therefrom. A control slide is pivotable about a pivot pin within the housing in a displacement increasing direction and a displacement decreasing direction to adjust pump displacement. A resilient structure biases the control slide in the displacement increasing direction. A pressure relief valve is mounted to the pivot pin and positioned along an outflow path leading pressurized lubricant from the control slide to the outlet. The pressure relief valve is biased in a closing direction and has a pressure receiving surface receiving pressure from the lubricant in the outflow path to urge the pressure relief valve in an opening direction. Opening the relief opening allows outflow of lubricant to relieve pressure in the outflow path.

14 Claims, 8 Drawing Sheets

(56) References Cited

U.S. PATENT DOCUMENTS

| | | | | |
|---|---|---|---|---|
| 2,635,551 | A * | 4/1953 | De Lancey | F04C 15/0046 417/220 |
| 2,952,215 | A | 9/1960 | Deschamps | |
| 3,729,277 | A | 4/1973 | Allen | |
| 8,142,173 | B2 | 3/2012 | Saga et al. | |
| 8,439,650 | B2 | 5/2013 | Beez et al. | |
| 8,496,445 | B2 | 7/2013 | Shulver et al. | |
| 9,347,344 | B2 | 5/2016 | Watanabe et al. | |
| 9,534,519 | B2 | 1/2017 | Valkenberg | |
| 10,030,656 | B2 | 7/2018 | Valkenberg | |
| 10,253,772 | B2 * | 4/2019 | Morton | F04C 14/18 |
| 2012/0199411 | A1 | 8/2012 | Nonaka et al. | |
| 2016/0186752 | A1 | 6/2016 | Valkenberg | |
| 2016/0363120 | A1 | 12/2016 | Meinig | |
| 2017/0234311 | A1 | 8/2017 | Watanabe et al. | |
| 2017/0314555 | A1 | 11/2017 | Imanaga | |
| 2017/0328363 | A1 * | 11/2017 | Morton | F04C 2/3448 |

FOREIGN PATENT DOCUMENTS

| | | | |
|---|---|---|---|
| KR | 10-2016-0112033 | A | 9/2016 |
| KR | 20160112033 | A * | 9/2016 |
| KR | 10-2018-0044699 | A | 5/2018 |
| KR | 20180044699 | A * | 5/2018 |

OTHER PUBLICATIONS

English Machine translation of KR20160112033A description (Year: 2016).*

Pivot pin, GM Genuine Parts 8634097 (see https://www.amazon.com/ACDelco-8634097-Equipment-Automatic-Transmission/dp/B0016IACH6, which part was made first available on Mar. 20, 2008) (Year: 2008).*

English Abstract for JP2012-007640 (Year: 2012).*

International Search Report and Written Opinion of the International Searching Authority dated Apr. 24, 2020 issued in corresponding International Application No. PCT/IB2020/050576 (8 pgs.).

Extended European Search Report dated Jun. 25, 2021, issued in corresponding European Patent Application No. 20736565.1 (7 pgs.).

International Preliminary Report on Patentability and Written Opinion of the International Searching Authority dated Aug. 12, 2021, issued in corresponding International Patent Application No. PCT/IB2020/050576 (6 pgs.).

* cited by examiner

PRESSURE RELIEF VALVE INTEGRATED IN PIVOT PIN OF PUMP

CROSS REFERENCE TO RELATED APPLICATION

This application claims priority to U.S. Provisional Patent Application No. 62/799,449, filed Jan. 31, 2019, which is hereby incorporated by reference herein in its entirety.

BACKGROUND

Field

The present disclosure is generally related to a pump assembly having a pressure relief valve mounted to the pivot pin.

Description of Related Art

It is known to use electrical valves (e.g., pulse width modulation valves) in vane pumps and/or control valves to assist in controlling feed to/from control chambers of pumps. In some instances, panic or fail-safe valves have been provided to relieve pressure in such pumps. Typically, the pump housing includes a machined area to accommodate panic valves. In some cases, the panic valves are provided on top of or outside the pump housing, but in fluid communication with the pump. U.S. Pat. Nos. 8,496,445, 9,534,519, 9,347,344, and 10,030,656, and U.S. Patent Publication No. 20120199411 provide examples of placing panic valves outside or on a pump housing.

Some pump designs include an end-to-end path through the pivot pin body that direct fluid to an outlet from their chamber(s). For example, see U.S. Pat. Nos. 8,439,650, 2,952,215 and 2,142,275.

SUMMARY

It is an aspect of this disclosure to provide a pump for dispensing lubricant to a system. The pump includes: a housing; an inlet for inputting lubricant from a source into the housing; an outlet for delivering the lubricant to the system from the housing; a control slide pivotable about a pivot pin within the housing in a displacement increasing direction and a displacement decreasing direction to adjust displacement of the pump through the outlet; a resilient structure biasing the control slide in the displacement increasing direction; a rotor with at least one vane mounted in the housing for rotation within the control slide to pressurize the lubricant; at least one control chamber between the housing and the control slide for receiving pressurized lubricant to move the control slide in the displacement decreasing direction; and a pressure relief valve mounted to the pivot pin and positioned along an outflow path leading the pressurized lubricant from the control slide to the outlet. The pressure relief valve has a pressure receiving surface receiving pressure from the pressurized lubricant in the outflow path to urge the pressure relief valve in an opening direction. The pressure relief valve is biased in a closing direction to a closed position closing a pressure relief opening. Pressure on the pressure receiving surface moves the pressure relief valve in the opening direction to open the relief opening for outflow of the pressurized lubricant to relieve pressure in the outflow path.

Other aspects, features, and advantages of the present disclosure will become apparent from the following detailed description, the accompanying drawings, and the appended claims.

DETAILED DESCRIPTION OF THE PREFERRED EMBODIMENT(S)

Disclosed herein is a pump 10 that has a pivot pin that includes an integral pressure relief valve (a pressure relief valve is also sometimes referred to as a panic valve in the art) therein. As described in greater detail below, a body of the pivot pin acts as a housing or sleeve for this pressure relief feature. Generally, no fluid flows through the pivot pin itself. Further, a dedicated outflow path is provided in the pump.

Figure 1:
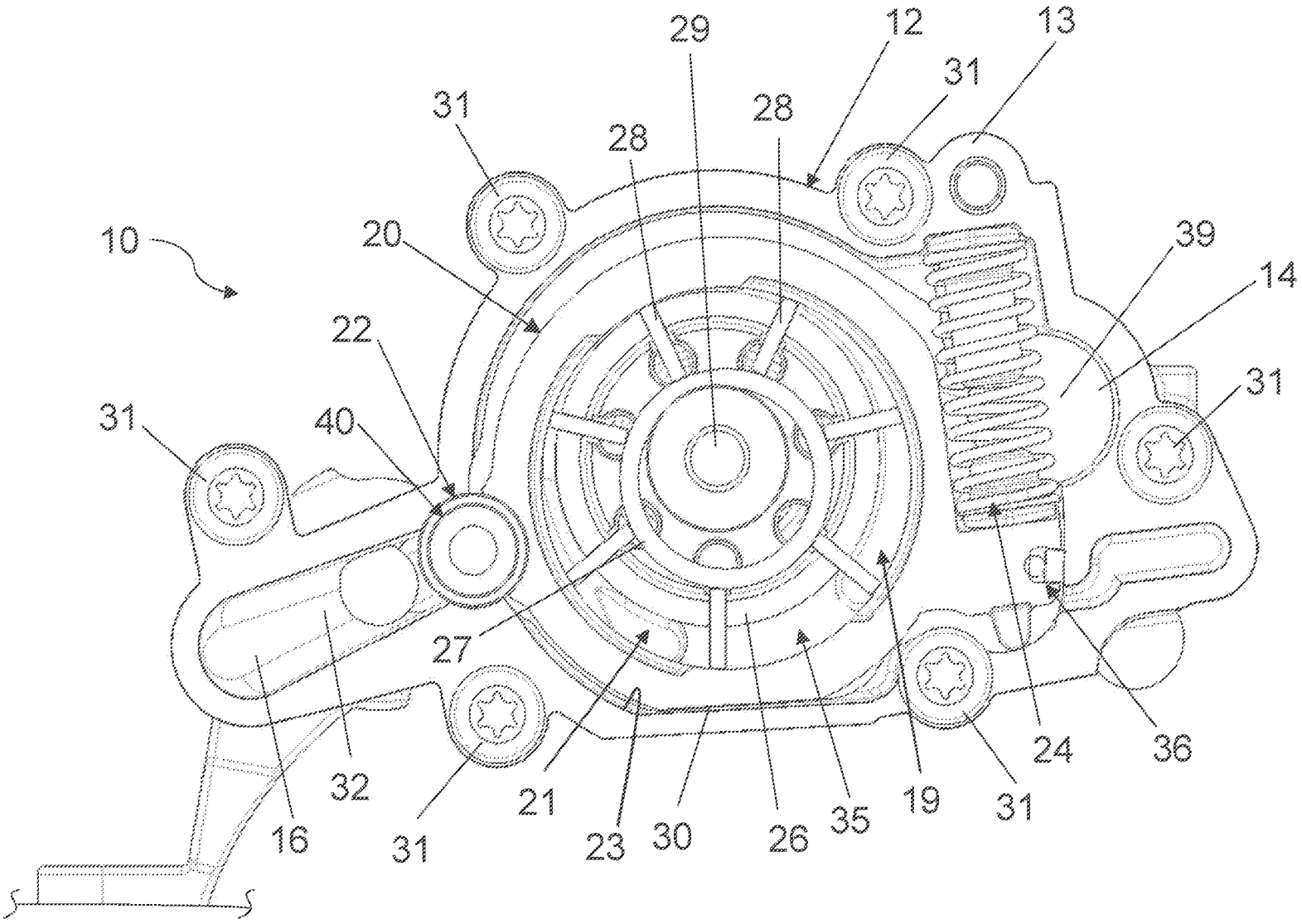
FIG. 1 is an overhead view of working parts of a pump as provided by the present disclosure.
Figure 8:
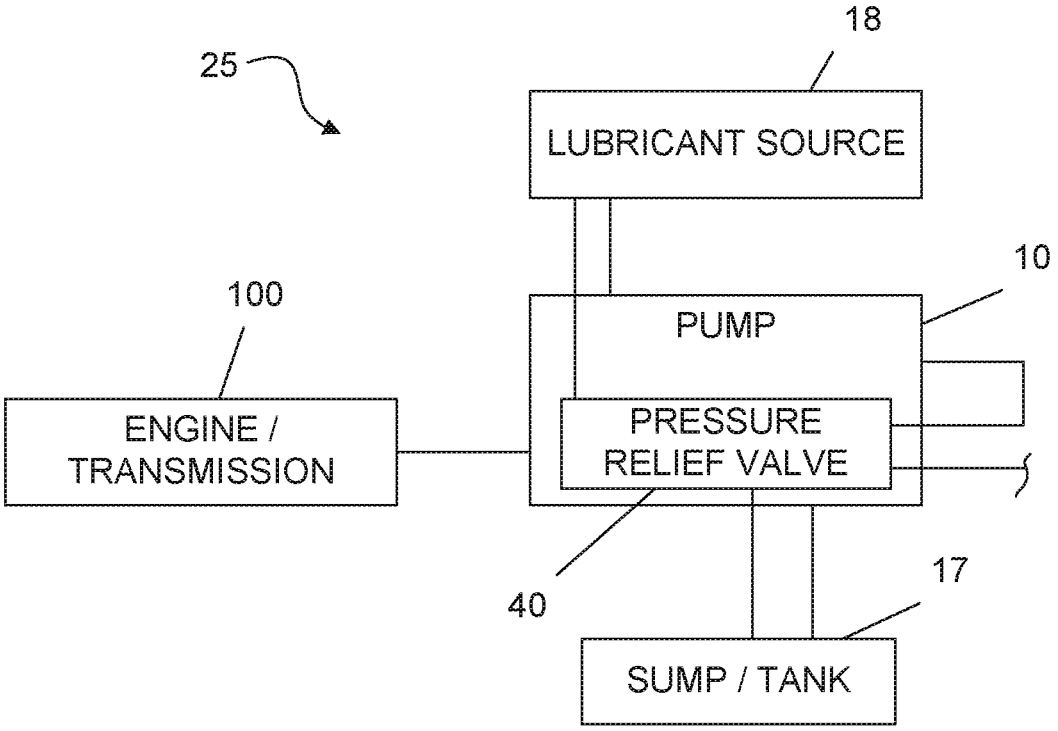
FIG. 8 is a schematic drawing of a system including the pump as disclosed herein.

FIG. 1 is a top or an overhead view of a pump 10, in accordance with an embodiment of the present disclosure, with its cover removed (although cover is not shown, fasteners 31 are shown for illustrative purposes only). The pump 10 is designed for dispensing lubricant to a system 100 (see FIG. 8), and may be provided as part of a system that contains both pump 10 and system 100 (e.g., such as a vehicle). Dispensing is intended to include circulation within a closed system (e.g., drawing lubricant in from a negative/lower pressure side and dispensing it to a positive/higher pressure side of the system. The pump 10 is a variable displacement vane pump for dispensing fluid or lubricant to a system, in accordance with an embodiment. The pump 10 includes a housing 12, an inlet 14, and an outlet 16. The inlet 14 receives fluid or inputs lubricant to be pumped (typically oil in the automotive context) from a source 18 (see FIG. 8) into the housing 12, such that the lubricant is pressurized via the pump components (e.g., rotor, vanes), and the outlet 16 is used to discharge or deliver the pressurized fluid or lubricant to the system 100 (e.g., to an engine or a transmission, as shown in FIG. 8) from the housing 12. A lubricant sump 17 (shown in FIG. 8) may be provided for holding lubricant, e.g., for input to the pump 10 and/or for receiving relief lubricant that is output from the housing 12. In engine applications, the sump 17 receives the lubricant exiting the engine 100, and is generally regarded as being on the lower or negative pressure side of the overall lubrication system (and may be at atmospheric pressure). The terms referring to pressure herein are relative to the system unless otherwise specified.

A control slide 20, a rotor 26, a drive shaft 29, and resilient structure 24 are provided in housing 12, as is generally known in the art for vane pumps.

The housing 12 may be made of any material, and may be formed by aluminum die cast, powdered metal forming, forging, or any other desired manufacturing technique. The housing 12 encloses an internal chamber. Walls of a base 13 define axial sides of the internal chamber and a peripheral wall 23 extends around to surround the internal chamber peripherally. A cover 15 (shown in FIG. 2) attaches to the base 13 of the housing 12, such as by fasteners 31 (e.g., bolts) that are inserted into various fastener bores 33 placed along or around the housing 12. The cover is not shown in FIG. 1, for example, so that some of the internal components of the pump 10 can be seen. The cover may be made of any material, and may be formed by stamping (e.g., stamping steel or another metal), aluminum die casting, powdered metal forming, forging, or any other desired manufacturing technique. The cover 15 helps enclose the internal control chamber of the pump 10 along with base 13. A gasket or other seal(s) may optionally be provided between the cover and peripheral wall 23 of the housing 12 to seal the internal chamber. Additional fastener bores for receipt of fasteners may be provided along the peripheral wall of the pump 10, to secure or fix the pump 10 to an engine, for example.

The housing 12 has at least one inlet port 19 for intaking fluid to be pumped under negative pressure, and at least one outlet port 21 for discharging the fluid under positive pressure. The inlet port 19 receives intake fluid (lubricant) from the inlet 14, and the outlet port 21 outputs fluid (pressurized lubricant) to the outlet 16. An inlet path 39 may be provided between the inlet 14 and the inlet port 19. Similarly, an outlet path 32 may be provided between the outlet port 21 and outlet 16. The inlet port 19 and outlet port 21 each may have a crescent shape, and may be formed through the same wall located on one axial side or both axial sides of the housing (with regard to the rotational axis of the rotor 26), in accordance with an embodiment. The inlet and outlet ports 19, 21 in the illustrated embodiment are disposed on opposing radial sides of the rotational axis of the rotor 26. These structures are conventional, and need not be described in detail. The shape of the inlet 14 and/or outlet 16 and/or ports 19, 21 and/or paths 32, 39 is not intended to be limiting. Other configurations may be used, such as differently shaped or numbered ports, etc. Further, it should be understood that more than one inlet or outlet may be provided (e.g., via multiple ports).

The pump 10 also has a rotor receiving space 35 (or pocket), which may be provided within the control slide 20. In the illustrated embodiment, the control slide 20 is in the form of a control ring. The rotor 26 may have a hole or opening with a configuration or shape that compliments the design, configuration, or shape of drive shaft 29, such that it receives and/or connects with the drive shaft 29 that drives the rotor 26 of the pump. This rotor receiving space 35 communicates directly with the inlet and outlet 14, 16 for drawing in oil, lubricant, or another fluid under negative intake pressure through the inlet 14, and expelling the same under positive discharge pressure out the outlet 16.

The rotor 26 is rotatably mounted in the housing 12 within the rotor receiving space 35 of the control slide 20. The rotor 26 is configured for rotation within and relative to the control slide 20. The rotor 26 has a central axis that is typically eccentric to a central axis of the control slide 20. The rotor 26 is connected to drive shaft 29 which is driven about axis D-D by a drive input in a conventional manner, such as via a drive pulley, another drive shaft, engine crank, or gear. The rotor receiving space 35 is central to the rotor 26.

The rotor 26 has at least one radially extending vane 28 mounted to the rotor 26 for radial movement and a vane ring or hub 27. The rotor 26 and vane(s) 28 are mounted in the housing for rotation within the control slide 20 to pressurize the input lubricant. The at least one vane 28 is configured for engagement with an inside surface of the control slide 20 during rotation thereof. Specifically, each vane 28 is mounted at a proximal end in a radial slot in the central ring 27 of the rotor 26 in a manner that allows them to slide radially. Centrifugal force may force the vane(s) 28 radially outwardly to engage and/or maintain engagement between distal end(s) of the vane(s) and an inside or inner surface of the control slide 20 during rotation thereof. This type of mounting is conventional and well known. Other variations may be used, such as springs or other resilient structures in the slots for biasing the vanes radially outwardly, and this example is not limiting. Thus, the vane(s) 28 can be sealingly engaged with the inner surface of the control slide 20, e.g., by the vane ring 27, such that rotating the rotor 26 draws fluid in through the inlet 14 by negative intake pressure and outputs the fluid out through the outlet 16 by positive discharge pressure. Because of the eccentric relationship between the control slide 20 and the rotor 26, a high pressure volume of the fluid is created on the side where the outlet 16 is located, and a low pressure volume of the fluid is created on the side where the inlet 14 is located (which in the art are referred to as the high pressure and low pressure sides of the pump). Hence, this causes the intake of the fluid through the inlet 14 and the discharge of the fluid through the outlet 16. This functionality of the pump is well known, and need not be described in detail further.

Figure 2:
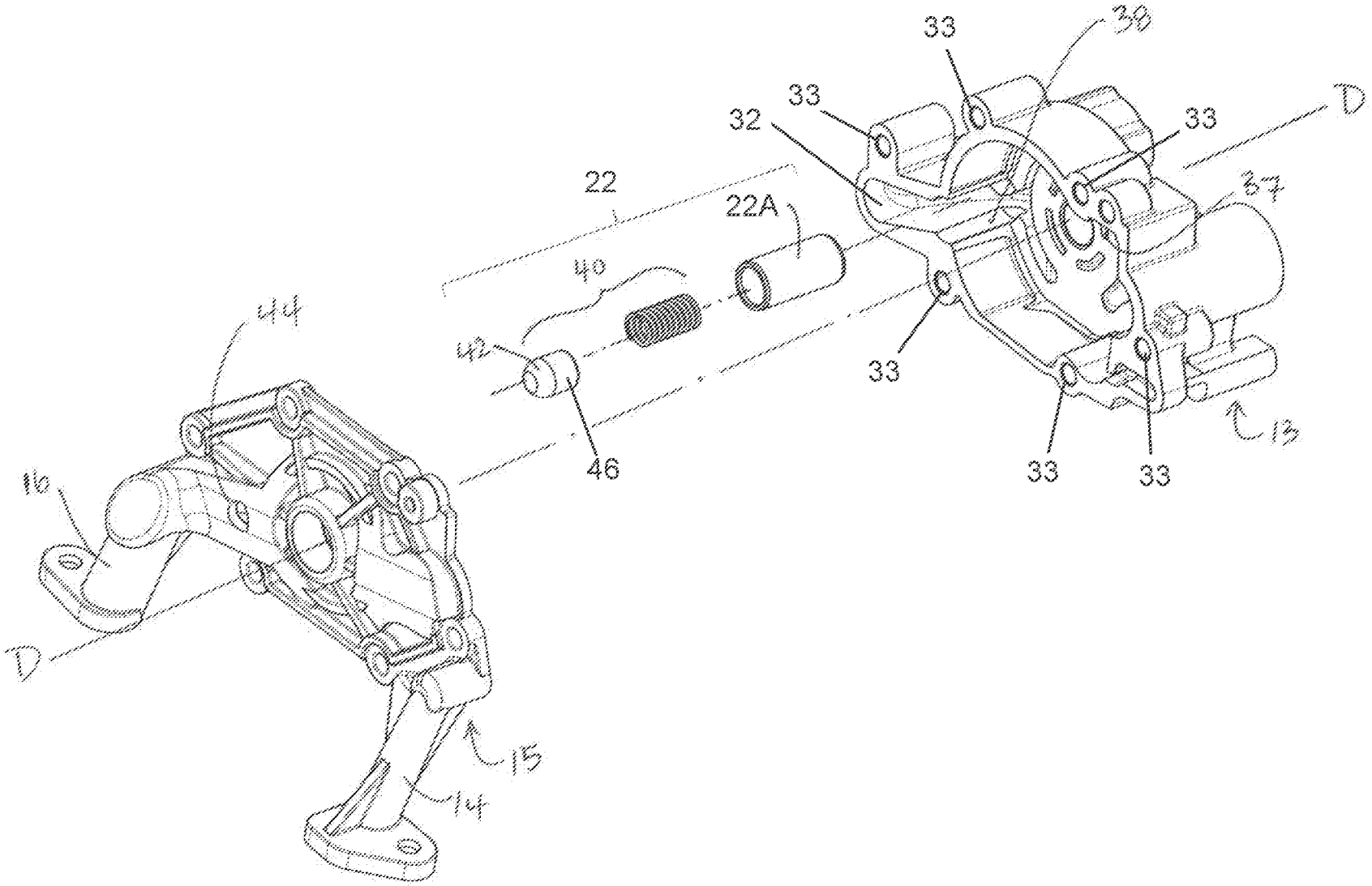
FIG. 2 is an exploded view of the housing of the pump of FIG. 1 along with a pivot pin and a pressure relief valve, in accordance with an embodiment.

The control slide 20 is pivotable about a pivot pin 22 (which pivots about axis A-A (see FIG. 3)) within the housing 12 in a displacement increasing direction and a displacement decreasing direction, to adjust displacement of the pump 10 and delivery of lubricant through the outlet 16 (e.g., as fed through the outlet port). The pivot pin 22 may be mounted to the housing 12 and is fixed in an axial direction. In an embodiment, the pivot pin 22 is mounted in a position that is adjacent to the outlet 16. In an embodiment, the pivot pin 22 is provided on an opposite radial side of the housing 12 as compared to the inlet 14. In an embodiment, the pivot pin 22 may be press fit into a bore 38 in the housing 12. FIG. 2 shows an example of such a bore 38. The bore 38 may be partially formed within the base 13 of the housing 12 and shaped to receive the body of the pivot pin 22 therein. For example, in this illustrated embodiment, bore 38 is formed via two rounded walls who radii are sized based on the outside diameter of the pivot pin 22. The bore 38 may be molded or machined into the housing 12. Additional features of the pivot pin 22 are described in greater detail below with reference to FIGS. 4-5.

Typically, the resilient structure 24 may bias or urge the control slide 20 in or towards its first slide position, i.e., in a displacement increasing direction. In the illustrated embodiment, the resilient structure 24 is a spring, such as a coil spring. In accordance with an embodiment, the resilient structure 24 is a biasing member for biasing and/or returning the control slide 12 to its default or biased position (displacement increasing direction). The control slide 20 can be moved against the spring or resilient structure to decrease eccentricity with the rotor 26 based on the pressure within the housing 12 outside the control slide 20 (acting in the displacement decreasing direction against the resilient structure 24) to adjust displacement and hence output flow. The housing 12 may include a receiving portion 37 for the resilient structure 24, partially shown in FIG. 2, for example, defined by portions of the peripheral wall 23, to locate and support the structure (or spring). The control slide 20 may also include a radially extending bearing structure defining a bearing surface against which the resilient structure 24 is engaged, for example. Other constructions or configurations may be used.

A control chamber 30 is provided between the housing 12 and the control slide 20 for receiving pressurized lubricant therein (e.g., see FIG. 1 showing the chamber between the outside shape of the slide 20 and the pump housing 12 (e.g., peripheral wall 23), wherein the control chamber 30 extends between the pivot pin 22 on the left side and seal 36 that is spaced from the pivot pin 22, e.g., at the right side of the slide). One or more seals may be provided between the housing 12 and the control slide 20 (e.g., see seal 36), for example. In the illustrated embodiment of FIG. 1, only one seal 36 is shown, which is provided closer to/adjacent the resilient structure 24. A pressure change in the control chamber 30 can result in the control slide 20 moving or pivoting (e.g., centering) relative to the rotor 26, adjusting (e.g., reducing or increasing) displacement of the pump. The slide 20 may be moved based on the pressure of the lubricant being fed through inlet 14 (and inlet path 39) via inlet port 19 into the chamber 30, and directed towards outlet 16 (after pressurization). One of ordinary skill in the art will understand that as the pressure builds in the control chamber 30, it may overcome the force of the resilient member 24 on the control ring 20. Accordingly, the pressurized lubricant may then move the control slide 20 in an opposite direction, against the force of the resilient member 24. In an embodiment, when the control chamber 30 receives pressurized lubricant, it moves the control slide into its second slide position, i.e., the displacement decreasing direction.

The outflow path 32 is provided in the housing for leading the pressurized lubricant from the control slide 20, chamber 30, and outlet port 19 to the outlet 16. Specifically, in an embodiment, the outflow path 32 is a passageway that is formed in an underside of the cover 15 and base 13 of the housing 12, and is provided around and above the pivot pin 22, as shown in greater detail in FIGS. 6A and 6B.

Figure 3:
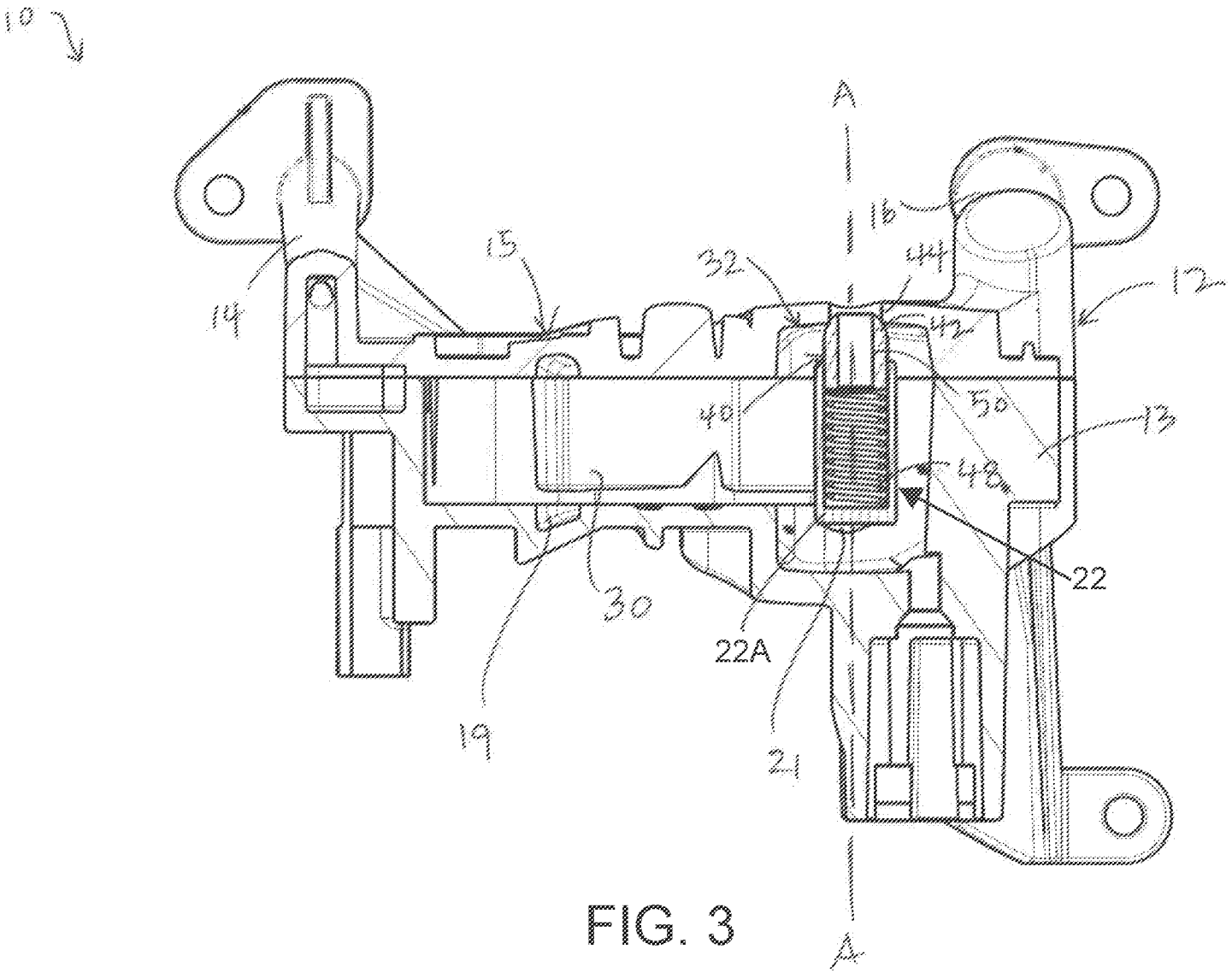
FIG. 3 is a cross sectional view of the herein disclosed pump in accordance with an embodiment.
Figure 4:
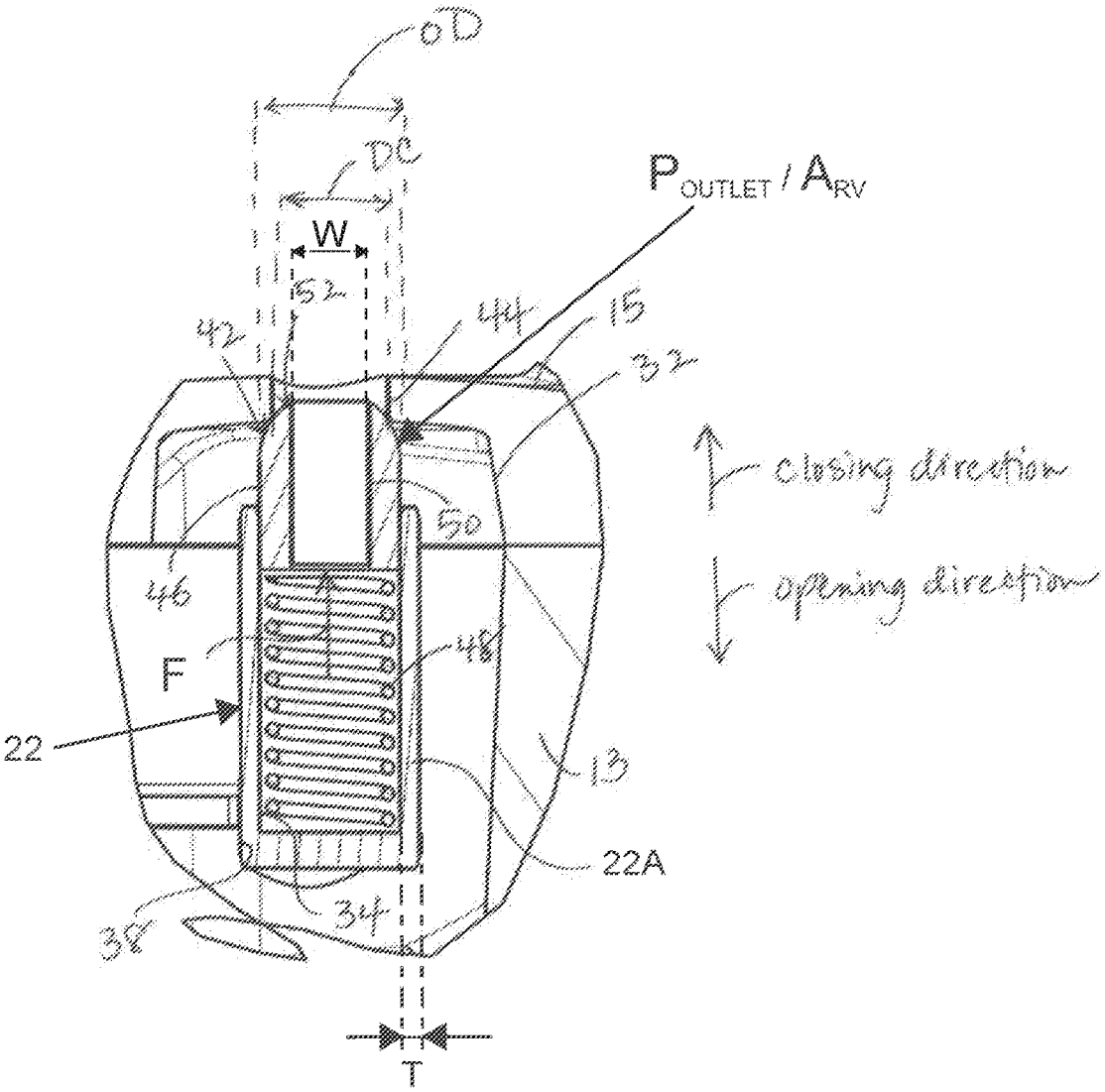
FIG. 4 is a detailed view of the cross section of FIG. 3.

The pump 10 also includes a pressure relief valve 40 (or "panic valve") provided in its housing 12. FIGS. 3 and 4 show a cross-sectional views of such a valve 40. The pressure relief valve 40 is mounted to the pivot pin 22 and positioned along the outflow path 32 (see FIGS. 6A-6B) leading the pressurized lubricant from the control slide 20/chamber 30 to the outlet 16. As better shown in FIG. 4 and FIG. 5, the pressure relief valve 40 has a pressure receiving surface 42 receiving pressure from the pressurized lubricant directed into the outflow path 32 and towards the outlet 16. In an embodiment, the pressure loading area is an area that is provided between at least an outer perimeter/diameter of the valve at this surface 42 and the cover 15. Depending upon the amount of pressure supplied to this area and thus applied to the pressure receiving surface 42, the valve element 46 of the relief valve 40 may be configured to move between a default (home), closed position and an open position. In accordance with an embodiment, this pressure receiving surface 42 is designed to urge the pressure relief valve 40 in an opening direction (e.g., in a downward direction as shown in FIG. 4) when the amount of pressure from pressurized lubricant in the outflow path 32 exceeds a predetermined amount (which is explained in greater detail below). As seen in the illustrated embodiment of FIG. 6A, the pressure relief valve 40 is biased in a closing direction (e.g., in an upward direction as shown in FIG. 4) to a closed position (or home position), closing a pressure relief opening 44 provided in the housing 12 (e.g., in this embodiment, it is provided in the cover 15). Pressure on the pressure receiving surface 42 moves the pressure relief valve 40 in the opening direction, towards its open position such as shown in FIG. 6B, to open the relief opening 44 for outflow of the pressurized lubricant to relieve pressure in the outflow path 32 (i.e., wherein "relieve" or "relief" refers to decreasing pressure of the lubricant/fluid in the outflow path 32). Further details regarding movement of the valve 40 and flow through the outlet path 32 are discussed later below.

Figure 6B:
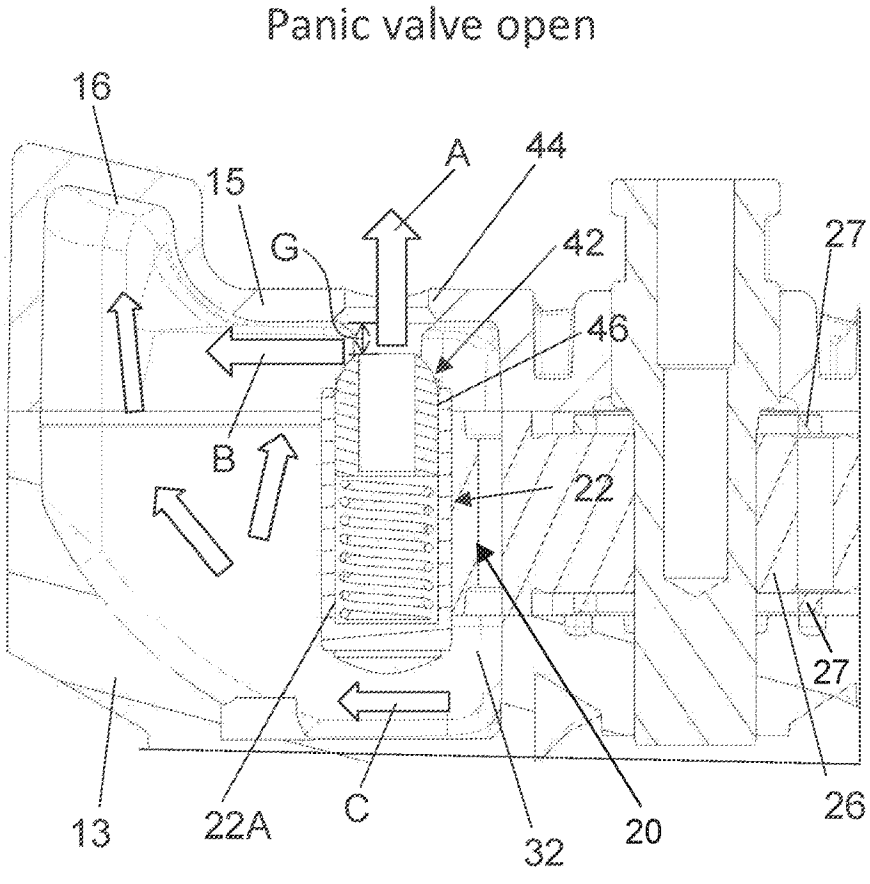
FIGS. 6A and 6B are cross sectional views through the pivot pin and outflow path of the pump of FIGS. 1 and 2, showing two positions of the pressure relief valve, in accordance with an embodiment herein.
Figure 6A:
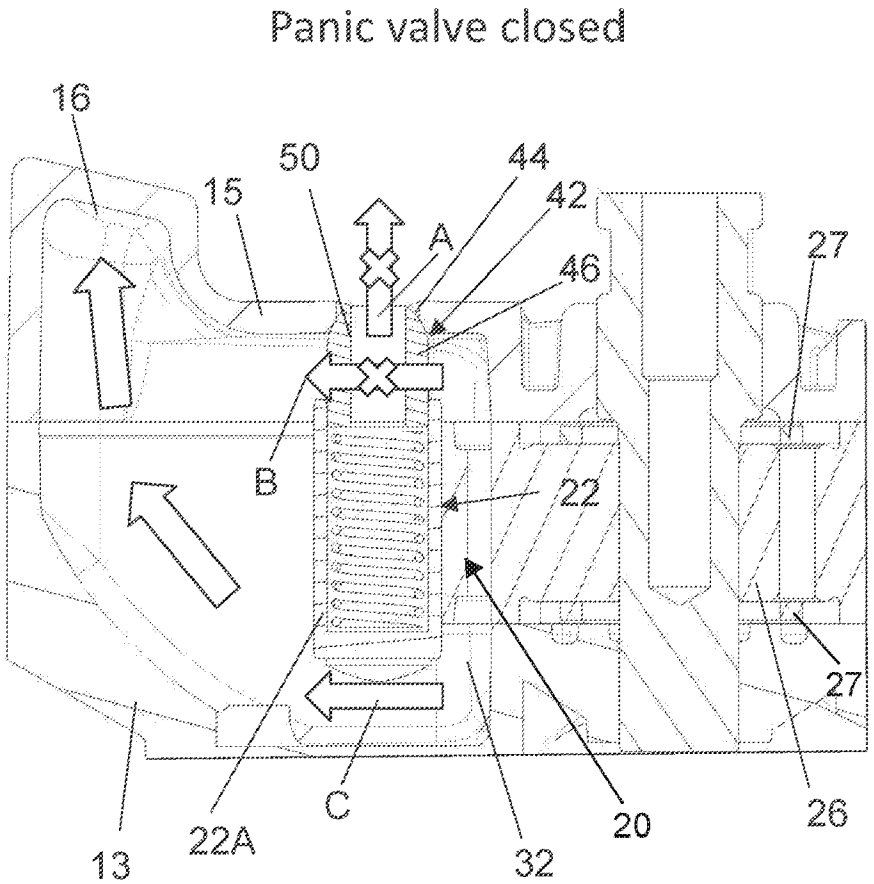

In an embodiment, the pivot pin 22, the pressure relief valve 40, and the pressure relief opening 44 are located at a juncture communicating the outflow path 32 and the control chamber 30. In one embodiment, the pressure relief opening 44 is provided in and through the cover 15 of the housing 12, such as shown in FIG. 4 and FIGS. 6A-6B.

Figure 5:
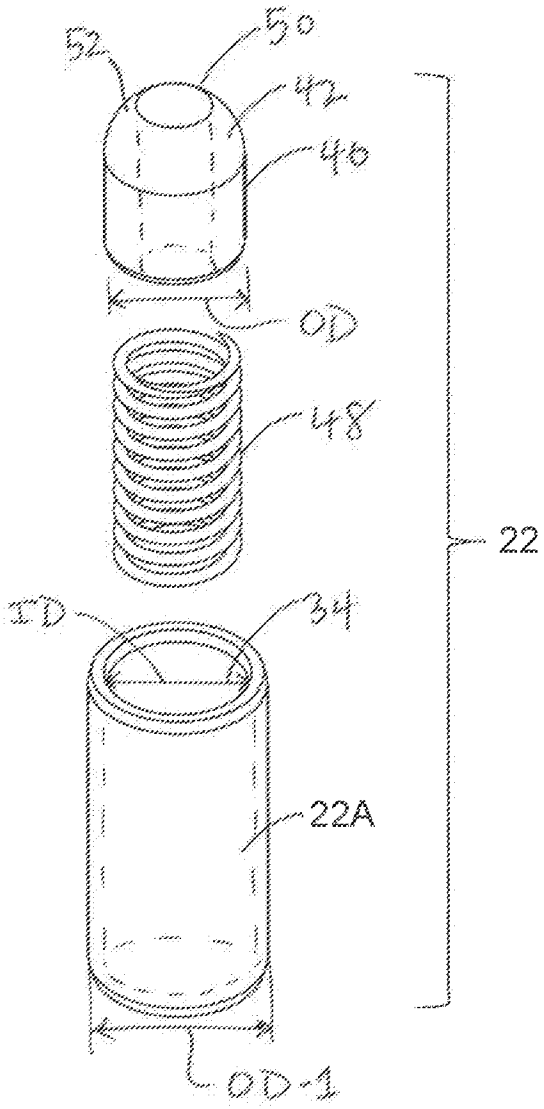
FIG. 5 is an exploded view of the pivot pin and pressure relief valve used in the pump.

FIGS. 4-5 show features of the pivot pin 22 and pressure relief valve 40 in greater detail in accordance with one embodiment. The pivot pin 22 has a body 22A with a hollow interior 34 having an inner diameter ID and an outside diameter OD-1, shown in FIG. 5. The body 22A has a wall thickness T, shown in FIG. 4, and is tubular-like in shape with a closed (bottom) end and an open (top) end. In an embodiment, the thickness T of the walls of the body may range between approximately 1 mm to approximately 3 mm (both inclusive). The pressure relief valve 40 may be mounted to and/or provided in the pivot pin 22. For example, in an embodiment, the relief valve 40 may include a valve element 46 that has the pressure receiving surface 42 thereon. In an embodiment, the valve element 46 is configured to be slidably mounted in the hollow interior 34 of body 22A of the pivot pin 22 for movement in the opening and closing directions to open and close, respectively, the pressure relief opening 44. That is, the pressure relief valve 40 is mounted within and integrally formed as part of the pivot pin 22 in the pump 10, in an embodiment.

According to one embodiment, as illustrated in FIG. 5, the pressure receiving surface 42 is an annular shoulder surface on the valve element 46 that is exposed to the pressurized fluid from the outflow path 32 when the valve element 46 is in the closed position. In one embodiment, the valve element 46 may have a rounded head 52 for engaging within the relief opening 44, as shown in FIG. 4. Accordingly, the annular shoulder or pressure receiving surface 42 may be provided adjacent to the rounded head 52 of the valve element, and, in an embodiment, the combination of the surface 42 and head 52 are configured to define the pressure loading area as well as receive the pressurized fluid/lubricant. As such, the pressure receiving area may be defined between at least the outer diameter of the valve element 46 and a contact diameter DC (see FIG. 4) of the rounded head 52 of the valve element 46. In this illustrative case, the pressure-loaded area shaped like a circular ring.

In an embodiment, the valve element 46 itself may optionally include a relief feature. As shown in FIG. 4, for example, the valve element 46 may have an axial through-hole 50 (or port or vent hole) that is in fluid communication with the hollowed body 22A of the pivot pin. The axial through hole 50 may be axially aligned with the pressure relief opening 44. While generally lubricant will not flow (end-to-end) through the pivot pin itself, some lubricant may collect incidentally within the hollow interior 34 of the pivot pin 22 as the pressure relief valve 40 moves between its closed and opened positions (e.g., it may seep through the valve element 46 and hollow interior 34 interface and/or through through-hole 50). Accordingly, any such collected lubricant may be relieved through the axial through-hole 50. In an embodiment, the axial through-hole has a diameter or width W between approximately 1 mm to approximately 8 mm (both inclusive). In one embodiment, the width W of the through-hole 50 is between approximately 1 mm and approximately 3 mm (both inclusive). In an embodiment, the width W of the hole 50 is approximately 2 mm.

In one embodiment, the valve element 46 is a relief ball valve. In an embodiment the valve element 46 is a relief ball valve with an opening or through hole therein.

In an embodiment, the pressure relief valve 40 also includes a biasing spring 48 mounted within the hollow interior 34 of the body of the pivot pin 22. The biasing spring 48 may be used for urging the pressure relief valve 40/valve element 46 in the closing direction. That is, the biasing spring 48 provides a spring force F that pushes or urges the valve 40/valve element 46 to close the pressure relief opening 44. In an embodiment, the valve element 46 is urged into contact with, and, in some cases, at least partially into, the pressure relief opening 44, in order to close fluid communication from the outflow path 32 of the housing 12 through the opening 44. FIG. 4 illustrates one embodiment showing how the hollow interior 34 is configured to receive the spring 48 therein, with the valve element 46 provided on top of the spring 48 and also at least partially within the hollow interior 34 of the pivot pin 22. The spring force F urges the valve element 46 into contact with edges of the pressure relief opening 44 to close and/or limit any communication of lubricant through the opening 44 and outside of the housing. In an embodiment, such as shown in the Figures, spring 48 is a coil spring or helical compression spring. However, this is not intended to be limiting; for example, in other embodiments, spring 48 may be a leaf spring or a conical spring.

The spring force F of the spring 48 that is applied to the valve element 46 may be determined based on a size/area ($A_{RV}$) of the valve element 46 that is pressure-loaded or exposed to pressure from the lubricant within the outlet path 32 and a desired pressure ($P_{OUTLET}$) at which the valve element 46 should move. For example, in an embodiment, it may be desirable to institute pressure relief when output pressure of the pressurized lubricant in the outlet path 32 is greater than 10 bar. Based on the desired pressure and the design/area of the valve element 46 that receives such pressure (e.g., pressure receiving surface 42), the spring force F of the spring 48 may be calculated. Accordingly, implementation of such a spring force F of spring 48 may be based on the materials, design, size, pitch, number of coils, for example used to form the spring. In an embodiment, the range of pressure of the output lubricant applied to the valve element 46 in order to activate movement thereof is between approximately 3 bar to approximately 30 bar (both inclusive). In another embodiment, the pressure is approximately 10 bar to approximately 20 bar (both inclusive). In an embodiment, the spring force F is within a range of approximately 25 Newtons to approximately 200 Newtons (N) (both inclusive). In one embodiment, the spring force F is approximately 50 N to approximately 150 N (both inclusive). Any number of materials may be used for the spring 48. In one embodiment, the spring 48 of made of chrome-silicon. In an embodiment, the area $A_{RV}$ of the valve element 46 that is pressure-loaded is approximately 94 $mm^2$. In an embodiment, the area (surface 42) around and/or on the valve element 46 that is exposed to and receives pressure may be adjusted to allow for a robust spring designed in the environmental space provided. That is, the pressure receiving surface 42, rounded head 52, and/or cover 15/housing 12 may be altered as needed. In an embodiment, the spring 48 must not hit a solid height (i.e., the pitch of the spring must be calculated such that remains under at least some stress and not fully extendible) or, in the alternative, be overstressed.

The force of the biasing spring 48 may thus affect and/or determine the previously-described predetermined amount of pressure or force required to overcome and apply to the pressure receiving surface 42. Thus, a force greater than spring F (as applied to the valve element 46) must be applied to the pressure receiving surface 42 in order to move or urge the pressure relief valve 40 in its opening direction (i.e., downward, against the spring 48, as shown in FIG. 4). In an embodiment, the range or amount of movement of the valve element 46 relative to the body 22A of pivot pin 22 is directly proportional to the amount of pressure applied to at least the pressure receiving surface 42 (once the minimum pressure for moving the element 46 is reached) and in the pressure receiving area. That is, as the pressure force of the pressurized lubricant applied to surface 42 increases, the amount of downward movement of the valve element 46 into the interior 34 of the body 22A, against the force F of the spring 48, may also increase. Accordingly, the valve 40 does not necessarily have a set open position (or second position) that it is moved to.

FIGS. 6A and 6B are cross sectional views through the pivot pin 22 and outflow path 32 of the pump 10, showing two exemplary positions—i.e., a closed or inactive position (FIG. 6A) and an open or active position (FIG. 6B)—of the pressure relief (panic) valve 40, in accordance with an embodiment herein. Under normal operating conditions, when the valve 40 is inactive, i.e., closed, as shown in FIG. 6A, at least a top of the valve element 46 is in contact with cover 15 to close fluid communication through relief opening 44 (see "x" in arrow A of FIG. 6A). Additionally, fluid communication is substantially limited and/or prevented from moving over the pivot pin 22 and in an upper part of the outlet path 32 (see "x" in arrow B of FIG. 6A). The pressurized fluid/lubricant can only flow under the pivot pin (see arrow C in FIG. 6A) and/or around the body 22A within the outlet path 32 and towards the outlet 16.

When the pressure inside the pump 10, and thus outlet path 32, increases to level that is higher than desired, the pressure relief valve 40 will become active and open. The force generated by the pressurized fluid acts on the pressure receiving surface 42 of the valve element 46 in the pressure loading area between at least the outer diameter of the valve and a contact diameter of the valve element 46 with the cover 15. As shown in FIG. 6B, the increased pressure of the fluid/lubricant may move the valve element 46 (by pushing on surface 42) downwardly to an open position, pushing against and overcoming the force of the biasing spring 48, thereby moving the valve element 46 away from the cover 15, creating a gap G between at least the top of the valve element 46 and an underside of the cover 15/relief opening 44. This, in turn, opens and allows fluid flow through relief opening 44. Thus, in the open position, valve 40 allows fluid flow over the valve element 46 (see arrow B in FIG. 6B) and outside the pump 10 via fluid communication through relief opening 44 (see arrow A in FIG. 6B), along with allowing flow under the pivot pin 22 (arrow C in FIG. 6B) and/or around the body 22A through the rest of the outlet path 32 to outlet 16. The resulting gap G provided between the relief opening 44 and top of the relief valve 40 as the valve/valve element 46 is moved downward to its open position allows lubricant from the outflow path 32 to flow outward through opening 44 in the cover 15. As result, the pressure in the outlet path 32 decreases.

As the pressure in the outlet path 32 decreases, the fluid pressure acting on the valve element 46 also decreases. The valve element 46 may/will thus move, as a result of the force from the biasing spring 48 that acts on the valve element 46, back to its home or closed position, shown in FIG. 6A.

In one embodiment, the relief opening 44 is open externally to ambient atmosphere. Accordingly, when the pressure relief valve is opened, any outflowing lubricant from the outflow path 32 that is being relieved via relief opening 44 may be discharged to the atmosphere. In another embodiment, the relief opening 44 is fluidly communicated to a sump 17 (see FIG. 8) (or tank) of the pressurized lubricant. In yet another embodiment, lubricant from outflow path 32 that is relieved through relief opening 44 may be directed to lubricant source 18 (see FIG. 8). In still yet another embodiment, lubricant from the outflow path 32 relieved through relief opening 44 may be directed back to the inlet 14 of the pump 40 itself. In any number of embodiments, the relief opening 44 may optionally connect with/to a conduit (not shown) for fluid communication to one or more of: sump 17, lubricant source 18, inlet 14, and/or a surrounding atmosphere or environment.

The use of the disclosed pressure relief valve 40 in a pivot pin 22 is not meant to be limited by size or dimension, or limit the size and/or dimensions of the pivot pin 22 itself. The length of the body 22A is dependent upon the length of the rotor, vanes, and rotating elements as well as the housing and environment in which the pump is configured for use. In an embodiment, the pivot pin 22 may have a larger diameter (e.g., 12-25 mm) as compared to diameters of standard pivot pins (e.g., 6-8 mm) to accommodate parts of the pressure relief valve. In one embodiment, the pivot pin 22 has an outer diameter of approximately 14 mm (millimeters) to approximately 20 mm (both inclusive). Using a larger diameter pivot pin bodies, i.e., greater than 12 mm, is not typical in the area of vane pumps for a number of reasons, including added costs. However, in this case, with the integration of the panic/relief valve within the pivot pin, added costs may be limited. For example, the surrounding environment may not need to accommodate a separate valve or include a separate housing for such a valve.

In an embodiment, the outer diameter OD of the valve element 46 and the inner diameter ID of the hollow interior 34 of the pivot pin are approximately 12 mm (millimeters) or more.

The size or diameter of the pressure relief valve opening 44 is not intended to be limiting. In an embodiment, the diameter of the opening 44 is approximately 9 mm.

In one embodiment, the contact diameter DC (see FIG. 4) of the rounded head 52 is similar or the same as the diameter of the pressure relief valve opening 44. In an embodiment, the contact diameter DC is approximately 9 mm.

Figure 7:
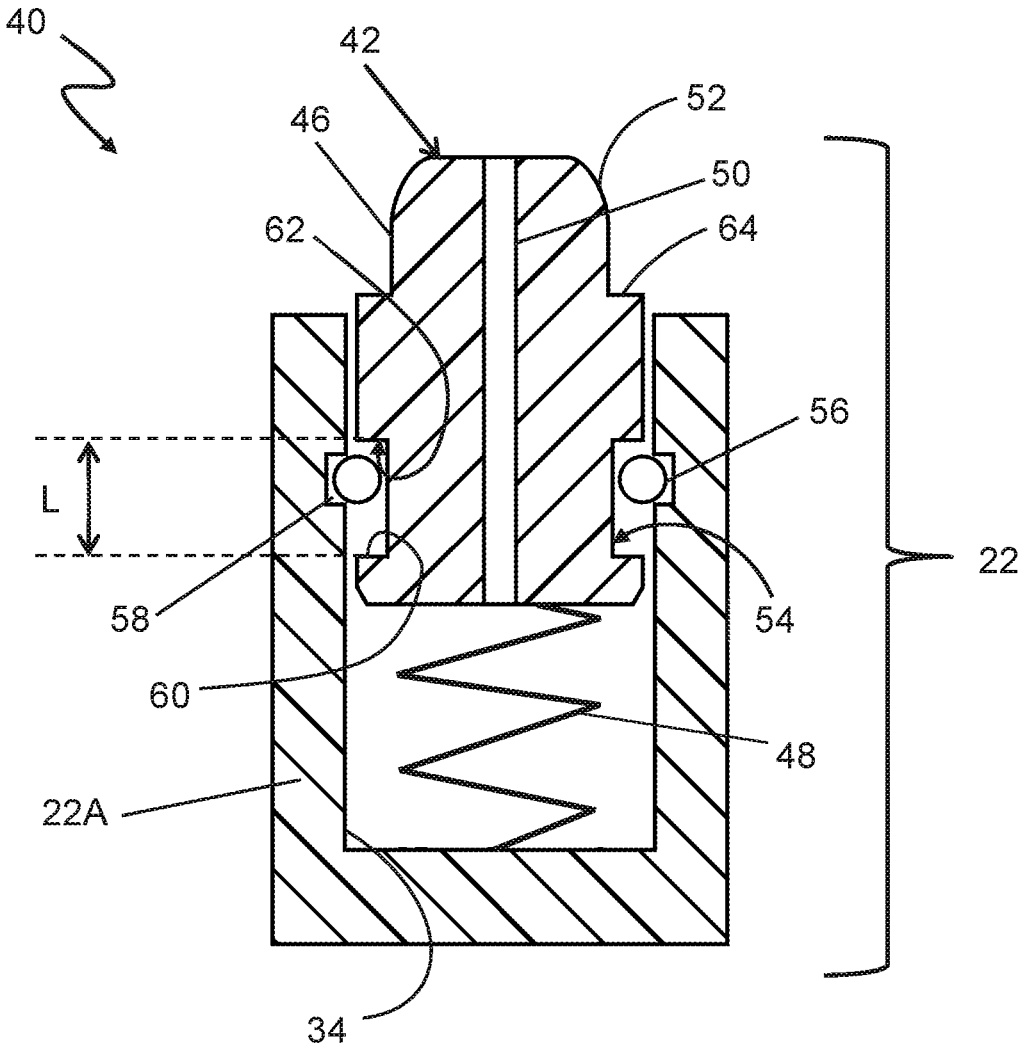
FIG. 7 is a cross sectional view of a pivot pin and pressure relief valve in accordance with another embodiment.

According to another embodiment, the valve element 46 may further features that limit upward and downward movement relative to the hollow interior 34 of the pivot pin 22. For example, as illustrated in FIG. 7, in one embodiment, a circular clip 56 may be placed within a receiving groove 58 formed in the wall of the hollow interior 34. Further, the valve element 46 may have an indentation 54 provided around its circumference, extending into its outer diameter OD, that is configured to receive at least a portion of the clip 56 therein. The indentation 54 has a length L and may include a top lip 62 and a bottom lip 60 at either end thereof. The bottom lip 60 may be provided at a bottom end of the valve element 46 in order to limit the upward movement of the valve element 46 as the biasing spring 48 pushes on the valve element 46, towards the closed position for the valve 40. The top lip 62 may limit the downward movement of the valve element 46 (and thus limit the resulting gap or size of the opening in the outflow path to allow relief lubricant to flow through relief opening 44) such that when pressurized lubricant pushes against pressure receiving surface to move the valve 40 to its open position, the valve element 46 is only moved a length equivalent to length L in the downward direction into the hollow interior 34 and relative to the body 22A of the pivot pin 22.

In one embodiment, the valve element 46 may include a circumferential edge 64 (see FIG. 7) or chamfer near a top portion thereof that acts as a pressure receiving surface. This edge 64 may be provided in addition to, or alternative to, the annular shoulder surface and/or rounded head 52 of the valve element 46.

The herein integrated pivot pin 22 and pressure relief valve 40 provides a number of improvements for use in a vane pump, such as pump 10. For example, the relief valve 40 is incorporated into the pump housing 12. Typically, the housing the pump must be formed to include a pocket or area that can accommodate a panic valve (or the like) in the housing, or just outside of the housing (e.g., on top or in fluid communication with the outlet, for example). Accordingly, the environment in which the pump is placed must further accommodate the addition of the panic valve. Because the pressure relief valve 40 of this disclosure is mounted to and/or is accommodated in the pivot pin 22 itself, casting the housing and machining of the housing is easier. Also, mounting of the pump 10 in a system does not necessarily need to consider providing room or accommodating the panic valve; e.g., if the panic valve were mounted to an outside, or to a part of the system, as in known implementations, a system needs to include an area for such as panic valve and/or include a fluid feed that leads to the panic valve for input. In the disclosure, a separate feed to the panic valve is not necessary, since it is exposed directly to the outflow path 32 to the outlet 16. Further, the pump 10 may also have a more compact design. Furthermore, preassembly of the relief valve 40 is also possible. The parameters needed to design the spring 48 and valve 40 are not intended to be limiting.

Among other features discussed throughout this disclosure, the incorporation of the above-described valve 40 features provides advantageous packaging options as compared to the prior art. Many known vane pumps are designed to utilize a control pressure on one side of the pivot pin, and the other side is inlet pressure or vented. Sometimes it has been difficult to route outlet pressure to the other side of the control slide without having more components (e.g., adding a plate in the housing) or another seal on the slide on either side of the pivot pin to allow the oil to pass to the outlet. There is generally no direct path from the outlet port to the other side of the vent/control pressure volumes. It is also sometimes difficult to find a location in the environment for the relief valve. This pivot pin 22 design, on other hand, solves such difficulties.

FIG. 8 is a schematic diagram of a system 25 in accordance with an embodiment of the present disclosure, using the pump 10. The system 25 can be a vehicle or part of a vehicle, for example. The system 25 includes a mechanical system 100 such as an engine (e.g., internal combustion engine) or transmission for receiving pressurized lubricant from the pump 10. The pump 10 receives lubricant (e.g., oil) from a lubricant source 18 (input via inlet 14) and pressurizes and delivers it to the engine 100 (output via outlet 16). The lubricant sump 17 may hold lubricant, e.g., for input to the pump 10. As discussed in detail previously, the sump 17 or tank may be used to collect relief lubricant (output from housing 12 through relief opening 44 via movement of valve 40) and/or additional lubricant output from the pump 10. In other embodiments, the sump 17 or tank, and/or lubricant source 18, and/or inlet 14, and/or atmosphere/surrounding environment may be used to collect relief lubricant (output from housing 12 through relief opening 44 via movement of valve 40).

While the principles of the disclosure have been made clear in the illustrative embodiments set forth above, it will be apparent to those skilled in the art that various modifications may be made to the structure, arrangement, proportion, elements, materials, and components used in the practice of the disclosure. For example, the disclosed pivot pin 22 and pressure relief valve 40 may be used in pumps that do not include vanes.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A pump for dispensing lubricant to a system, comprising:

a housing;

an inlet for inputting lubricant from a source into the housing;

an outlet for delivering the lubricant to the system from the housing;

a control slide pivotable about a pivot pin within the housing in a displacement increasing direction and a displacement decreasing direction to adjust displacement of the pump through the outlet;

a resilient structure biasing the control slide in the displacement increasing direction;

a rotor with at least one vane mounted in the housing for rotation within the control slide to pressurize the lubricant;

at least one control chamber between the housing and the control slide for receiving pressurized lubricant to move the control slide in the displacement decreasing direction;

an outflow path in the form of a passageway formed in the housing, for leading the pressurized lubricant from the control slide to the outlet;

a pressure relief valve mounted to the pivot pin and positioned along the outflow path, the pressure relief valve having a pressure receiving surface receiving pressure from the pressurized lubricant in the outflow path to urge the pressure relief valve in an opening direction to an open position; and a pressure relief opening provided in the housing, the pressure relief valve being biased in a closing direction to a closed position closing the pressure relief opening, wherein pressure on the pressure receiving surface moves the pressure relief valve in the opening direction to open the pressure relief opening for outflow of the pressurized lubricant to outside the housing, to relieve pressure in the outflow path, wherein, in the closed position of the pressure relief valve, the pressure relief valve and outflow path are configured to allow pressurized lubricant to flow under the pivot pin and/or around a body of the pivot pin, wherein, in the open position of the pressure relief valve, the pressure relief valve and outflow path are configured to allow pressurized lubricant to flow through the relief opening, and over the pivot pin and under the pivot pin and/or around the body of the pivot pin.

2. The pump according to claim 1, wherein the pivot pin has a hollow interior, the pressure relief valve comprising a valve element having the pressure receiving surface slidably mounted in the hollow interior for movement in the opening and closing directions to open and close the pressure relief opening.

3. The pump according to claim 1, wherein the pressure relief valve comprises a biasing spring mounted within the hollow interior and urging the pressure relief valve in the closing direction.

4. The pump according to claim 1, wherein the pressure relief opening is open externally to ambient atmosphere such that outflowing lubricant is discharged to the atmosphere.

5. The pump according to claim 1, wherein the pressure relief opening connects to a conduit fluidly communicated to a sump of the pressurized lubricant.

6. The pump according to claim 2, wherein the pressure receiving surface is an annular shoulder surface on said valve element exposed to the pressurized fluid from the outflow path when the valve element is in the closed position thereof.

7. The pump according to claim 1, wherein the housing comprises a base and a cover, the pressure relief opening being formed through said cover, wherein the outflow path is formed in an underside of the cover, wherein:

in the closed position, the pressure relief valve is configured to contact the cover to close the pressure relief opening; and the pressure relief valve is configured to move away from the cover such that, in the open position, a gap is provided between the pressure relief opening and the underside of the cover, to open and allow pressurized lubricant to flow through the pressure relief opening.

8. The pump according to claim 1, wherein the control chamber extends from the pivot pin to a seal spaced from the pivot pin.

9. The pump according to claim 1, wherein the pivot pin, the pressure relief valve, and the pressure relief opening are located at a juncture communicating the outflow path and the control chamber, providing a direct path for venting of the control chamber.

10. The pump according to claim 1, wherein the pivot pin is press fit into a bore in the housing.

11. The pump according to claim 2, wherein an outer diameter of the valve element and an inner diameter of the hollow interior of the pivot pin are 12 mm or more.

12. The pump according to claim 2, wherein the valve element has an axial through-hole that is axially aligned with the pressure relief opening and in fluid communication with the hollow interior of the pivot pin, allowing lubricant to incidentally collect within the hollow interior of the pivot pin but not to flow, end to end, through the pivot pin.

13. The pump according to claim 2, wherein the valve element has a rounded head for engaging within the pressure relief opening.

14. The pump according to claim 6, wherein the valve element has a rounded head for engaging within the pressure relief opening, the annular shoulder defined adjacent the rounded head.

* * * * *